US006471201B1

(12) United States Patent
van Lelyveld

(10) Patent No.: US 6,471,201 B1
(45) Date of Patent: Oct. 29, 2002

(54) APPARATUS FOR FEEDING SHEETLIKE MATERIAL

(75) Inventor: Maarten Willem van Lelyveld, Drachten (NL)

(73) Assignee: Neopost B.V., Drachten (NL)

( * ) Notice: Subject to any disclaimer, the term of this patent is extended or adjusted under 35 U.S.C. 154(b) by 21 days.

(21) Appl. No.: 09/664,590

(22) Filed: Sep. 18, 2000

(30) Foreign Application Priority Data

Sep. 17, 1999 (NL) ..... 1013082

(51) Int. Cl.[7] ..... G07F 11/00

(52) U.S. Cl. ..... 271/9.06; 271/145; 271/157; 271/171

(58) Field of Search ..... 271/145, 9.06, 271/171, 157, 223; 250/559.4; 399/124, 393

(56) References Cited

U.S. PATENT DOCUMENTS

| | | | | |
|---|---|---|---|---|
| 5,102,112 A | | 4/1992 | Takahashi | |
| 5,271,706 A | * | 12/1993 | Helbach et al. | 198/746 |
| 5,537,195 A | | 7/1996 | Sagara et al. | |
| 5,944,308 A | * | 8/1999 | McLeod et al. | 271/145 |

FOREIGN PATENT DOCUMENTS

| | | | | |
|---|---|---|---|---|
| JP | 60118537 | | 6/1985 | |
| JP | 1-1333838 | * | 1/1989 | B65H/3/66 |
| JP | 9142673 | | 6/1997 | |
| WO | 9112193 | | 8/1991 | |

OTHER PUBLICATIONS

Patent Abstracts of Japan, vol. 1997, No. 10, Oct. 31, 1997, abstract of Japanese Patent Application 09 142673.
Patent Abstracts of Japan, vol. 009, No. 275, Nov. 2, 1985, abstract of Japanese Patent Applicatin 60 118537.
Patent Abstracts of Japan, vol. 1998, No. 3, Feb. 27, 1998, abstract of Japanese Patent Application 09 290932.
Patent Abstracts of Japan, vol. 1999, No. 9, Jul. 30, 1999, abstract of Japanese Patent Application 11 116071.
Patent Abstracts of Japan, abstract of Japanese patent application 06009069.

* cited by examiner

*Primary Examiner*—Donald P. Walsh
*Assistant Examiner*—Kenneth W Bower
(74) *Attorney, Agent, or Firm*—Burns, Doane, Swecker & Mathis, L.L.P.

(57) ABSTRACT

An apparatus for feeding sheetlike material from a stack, with a holder for receiving a stack for supporting the stack and opposed side guides for guiding sheetlike material of the stack in a feeding direction. One of the side guides is displaceable relative to the other one. As, further, one of the side guides is movable between a working position projecting relative to the platform for guiding sheets in a working area and a filling position in which the working area is at least partly cleared for passing therethrough sheets to be placed in the bolder, filling of the apparatus is facilitated and this can be carried out faster.

9 Claims, 9 Drawing Sheets

APPARATUS FOR FEEDING SHEETLIKE MATERIAL

BACKGROUND OF THE INVENTION

This invention relates to an apparatus for feeding sheetlike material from a stack.

Such apparatuses are known from practice in many forms. A random example of such an apparatus is known, for instant, in the form of a side feed-in of a copier of the type 2140 of the firm OCE. This side feed-in is provided with side guides. One of the side guides is adjustable in that it can be moved between positions at different distance from the other side guide. By moving the side guide into a suitable position, the distance between the side guides can be adjusted to the width of the paper to be processed.

A disadvantage of this holder is that filling the holder is rendered more difficult in that the stack of sheets is to be brought between the side guides. A further problem is that especially in placing thicker stacks, the stack easily slides off.

SUMMARY OF THE INVENTION

It is an object of the invention to simplify filling of an apparatus for feeding sheetlike material and to enable this to be carried out faster, allowing the sheets to be better prevented from shifting relative to each other.

To that end, the invention provides an apparatus for feeding sheetlike material from a stack, comprising a holder for receiving a stack from sheetlike material with a platform for supporting the stack and opposed side guides for guiding sheetlike material from the sack in a feeding direction, at least one of the side guides being displaceable relative to the other one, and comprising a structure for feeding sheetlike material from the stack, wherein at least one of the side guides is movable between a working position projecting with respect to the platform for guiding sheets in a working area and a filling position in which the working area is at least partly cleared for passing therethrough sheets to be placed in the holder.

Further objects, aspects, effects and details of the invention are described in the following detailed description of a number of exemplary embodiments, with reference to the drawings.

DETAILED DESCRIPTION

Figure 1:
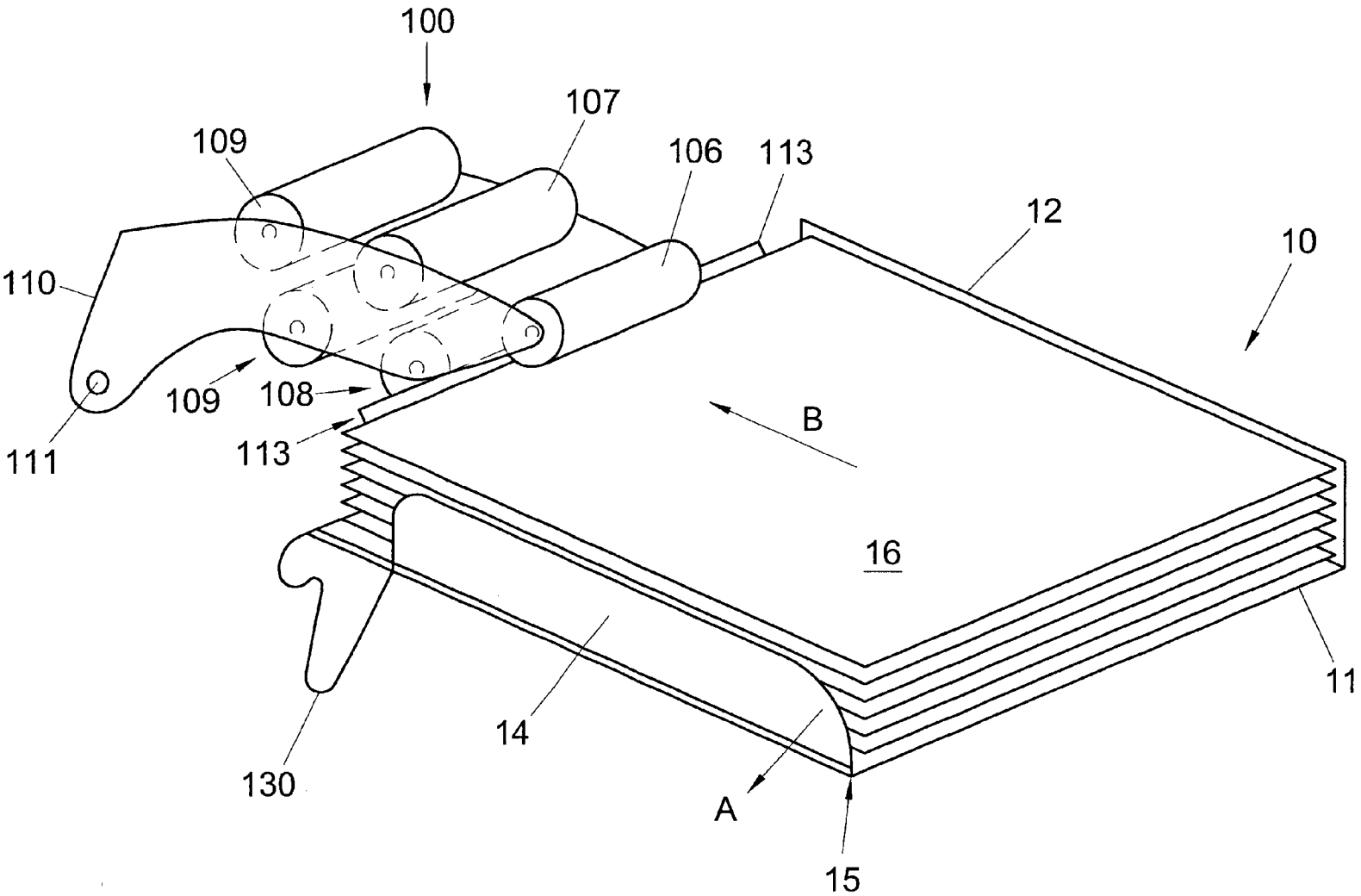
FIG. 1 is a perspective view of an apparatus according to the invention in filled condition.
Figure 2:
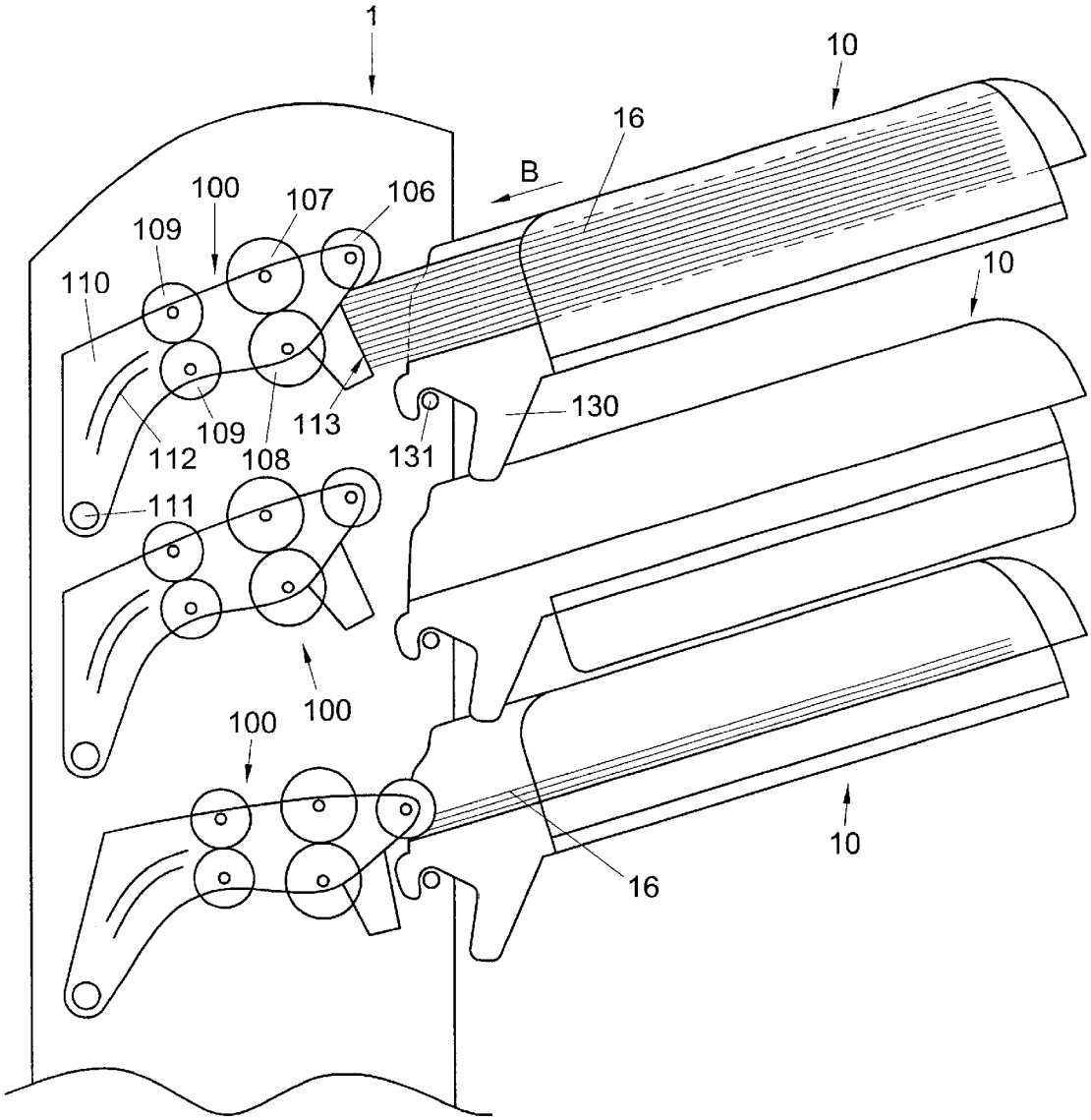
FIG. 2 is a cutaway side elevation of an example of an assembly with a triple apparatus according to FIG. 1 in operating condition.
Figure 3:
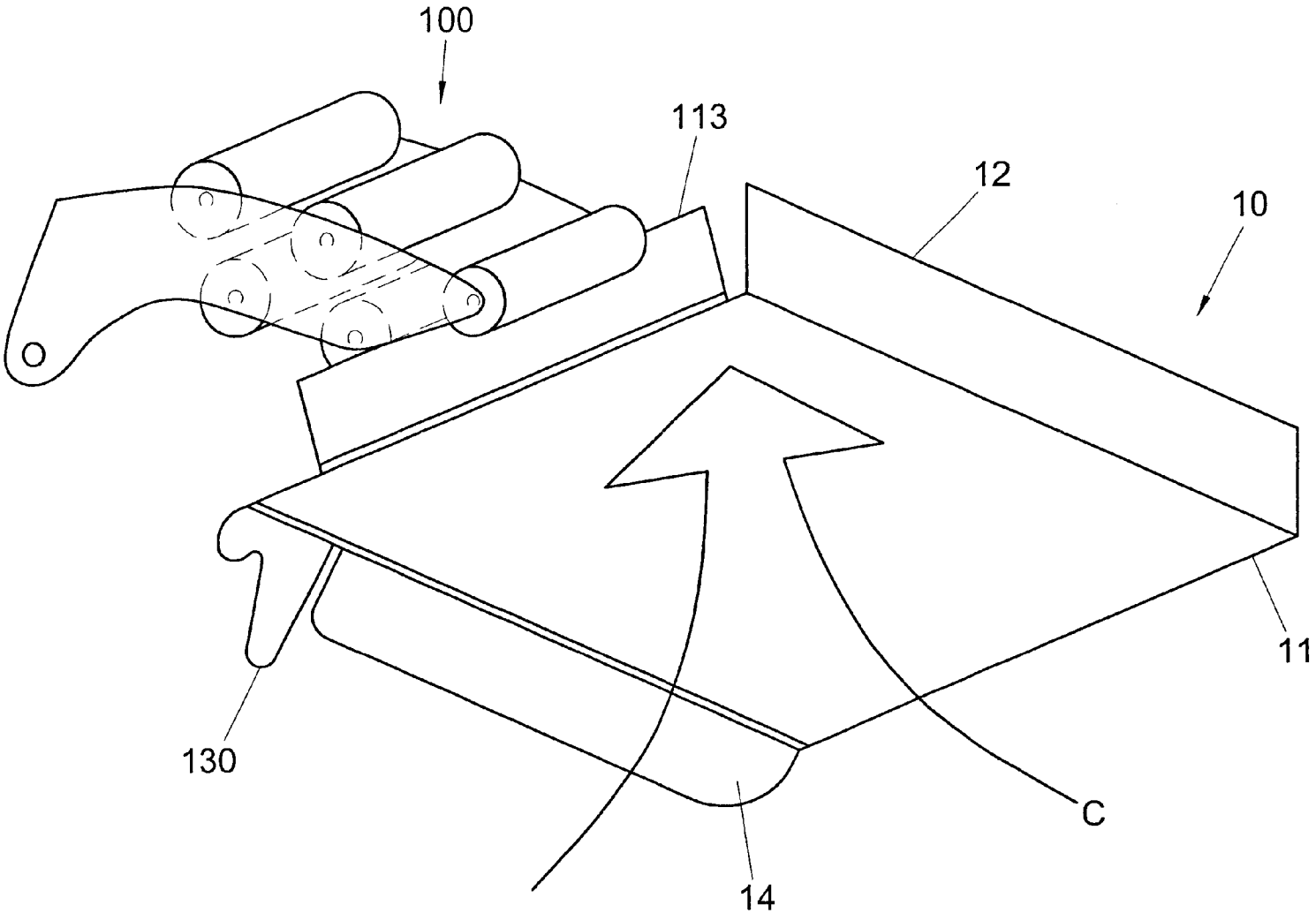
FIG. 3 is a perspective view of the apparatus according to FIG. 1, but in unfilled condition ready to receive a stack of sheets.

The apparatus shown in FIGS. 1–3 has a paper holder 10 with a platform 11 which is arranged for supporting sheetlike material. In this context, sheetlike material is understood to mean inter alia: paper sheets, sets of paper sheets, booklets, credit cards, and other flat information carriers which are substantially flat and lend themselves to forming a stack. According to this example, the dimensions of the platform 11 are such that it can receive a stack of A4 size paper sheets. On a longitudinal side, the platform 11 has a side guide in the form of a sidewall 12 which extends upwards from the platform 11. The side of the platform 11 located opposite the sidewall 12 is also provided with a side guide 14. This side guide 14 is connected by means of a hinge 15 with the platform 11, the axis of the hinge 15 being directed in the longitudinal direction of the platform 11. Present on the platform 11 is a stack of paper sheets 16. The side guide 14 can pivot relative to the platform 11 about the axis of the hinge 15 as is designated by the arrow A. Adjacent a downstream end, the holder 10 is provided with coupling elements 130 for coupling the holder to a frame of a sheet conveyor 1.

According to this example, the sheet holder 10 is detachably coupled to a sheet conveyor 1, which in turn can be part of, for instance, a mail item assembly system. The sheet conveyor 1 carries three separation devices 100 located above each other, each arranged for taking an uppermost sheet off the stack present in the paper holder 10. The paper holders 10 are each detachable connected, by means of the coupling elements 130, to the sheet conveyor 1, the coupling elements 130 each engaging coupling parts 131 of the sheet conveyor 1. Such separation devices 100 are described in applicant's international patent application PCT/NL91/00023, which is hereby referred to. The separation device 100 comprises a feed roller 106, a separation roller 107, a transport roller 108 and a pair of delivery rollers 109. The rollers 106–109 are journaled in a frame 110, which is suspended so as to be pivotable relative to the sheet conveyor 1 about a hinge 111. Further, the frame 110 under the feed roller 106 is provided with a stop 113 against which the stack 16 abouts in the holder 10 in operating condition, as is shown in the upper separation device 100 in FIG. 2.

In operation, the frame 110 assumes a pivoted position about the hinge 111, such that the feed roller 106 rests on the stack 16. Through rotation of the feed roller 106, driven by a drive not shown, an uppermost sheet is then taken off the stack in a direction indicated by an arrow B directed in the longitudinal direction of the sheets, to the separation device 100. The sheet thus taken off is then transported further between the rollers 107, 108, under retention of any next sheet that may have been carried along, to pass between the rollers 109. The rollers 109, finally, transport this sheet into a waiting position and then, upon command, further via guides 112 in the direction of a transport track, not shown, for further transport by the sheet conveyor 1.

In FIG. 3, the holder 10 is shown without paper, with the side guide 14 in a filling position. The side guide of the central holder 10 shown in FIG. 2 is also in the filing condition, ie., with the side guide 14 hinged downwards about the hinge 15. As a result, a stack of paper can be introduced into the holder 10 unhindered. The arrow C indicates roughly along which paths the sheetlike material can be brought into the holder. Owing to the fact that the side guide 14 in the filing condition is located largely outside of the working area, filling can take place readily and fast without the side guide being in the way. This allows the stack of paper to be passed in a direction oblique or transverse to the longitudinal direction of the side guide 14 through the working area of that side guide. In this example, the stack of paper is positioned during filling by pushing the stack against the sidewall 12 and the stop 113 of the separation device 100, with the angle included by the sidewall 12 and the stop 113 serving as stop, which is to ay that the other side guide also functions as stop, which further facilitates filling. The separation device 100 is in an upwardly swung position with respect to the platform 11 to thereby provide room under the feed roller 106 to introduce the stack 16 and also to bring the stop 113 in the stop position.

Owing to the side guide 14 in the filling position being moreover in a lowered position, it does not obstruct the view of the holder 10, nor is it an obstacle to the hands of the person holding the stack 16 to be placed.

After filling, the side guide 14 is pivoted upwards about the hinge 15 into the working position. In the working position, the side guide 14 supports one side of the stack. Also, the separation device 100 is lowered, such that the roller 106 rests on the uppermost sheet of the stack 16. When the separation device 100 takes a sheet off the stack, the uppermost sheet is displaced in the feeding direction designated by the arrow B, with the sheet being guided by the sidewall 12 and the side guide 14. As the successive uppermost sheets are taken off the stack 16, the separation device 100 moves down, as shown in the lowermost holder in FIG. 2. As the side guide 14, when it is being closed, moves towards the stack 16, it additionally has a press-on effect, so that the stack, if necessary, is aligned further.

That the side guide 14 pivots about a pivot axis which is directed in the feeding direction provides the advantage that the side guide 14 in the filling condition projects only to a slight event. As this a is moreover located close to a plane dewed by the platform 11, the side guide moreover pivots downwards from the working position to the filling position, so that in the filling position the side guide is located outside the working area, which is advantageous to further facilitate filling.

For refilling the holder 10, the side guide 14 can then be moved from the working position to the filling position again, whereby the side guide 14 is placed outside the working area again and filling can take place unhindered.

Figure 4:
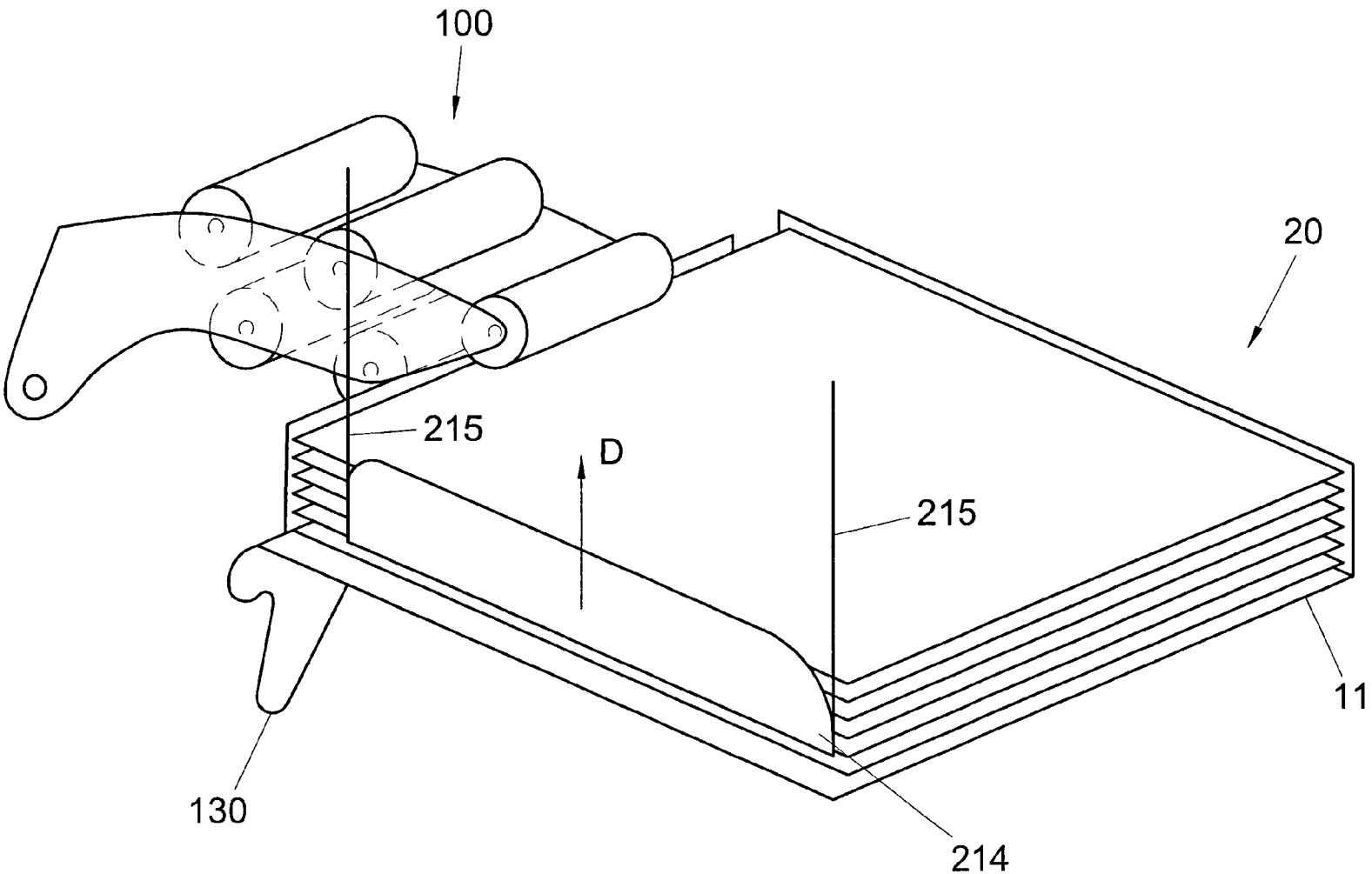
FIG. 4 is a perspective view of a second example of an apparatus according to the invention.

FIG. 4 shows an alternative embodiment of the invention. The holder 20 is largely identical to the holder 10 according to the first exemplary embodiment, but is different as regards the construction of the movable side guide 214. The working position of the side guide 214 corresponds to the working position as described in the first exemplary embodiment However, the side guide 214 is moved to the filling position by moving the side guide 214 substantially vertically in a direction away from the platform 11 and up along the stack of sheets, as indicated by an arrow D in FIG. 4. In this embodiment, the side guide 214 is guided in that upwardly protecting guide bars 215 are guided in bushes (not shown) located above the side guide 214. In the filling position, the side guide 214 is located outside the working area of the holder, so that filling of the holder 20 as described hereinbefore can take place in a simple manner.

Figure 5:
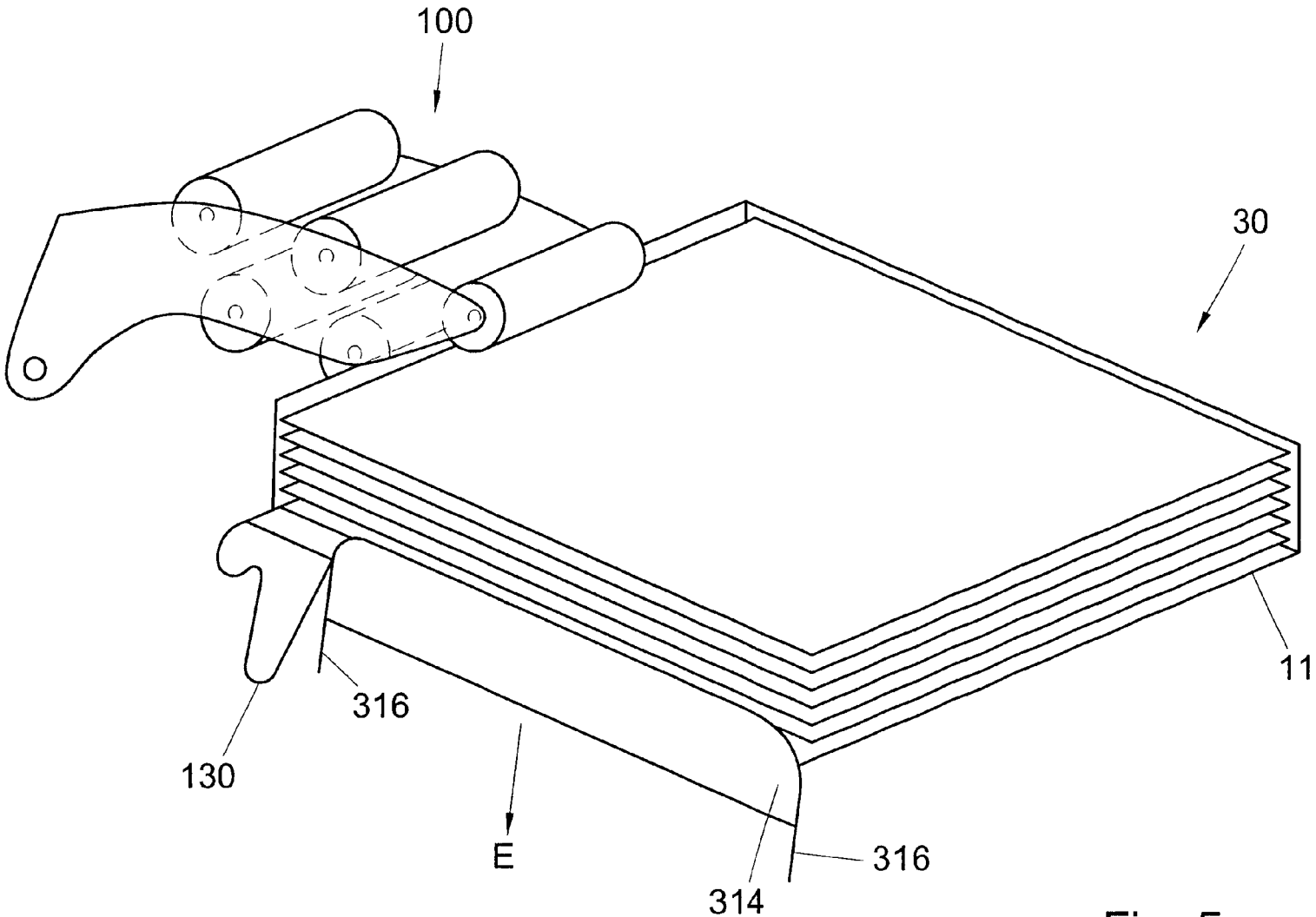
FIG. 5 is a perspective view of a third example of an apparatus according to the invention.

FIG. 5 shows a further alternative embodiment of the invention. The holder 30 is largely identical to the holder 10 according to the first exemplary embodiment, but is different as regards the construction of the movable side guide 814. The working position of the side guide 314 corresponds to the working position as described in the first exemplary embodiment. However, the side guide 314 is moved to the filling position by moving the side guide 314 substantially vertically downwards, as indicated by an arrow E in FIG. 5, with the side edges of the guide 314 sliding in guides 316 extending downwards from the platform 11 in the direction of arrow E. in the filling position, the side guide 314 is located below the level of the platform 11, and hence outside the working area of the holder 30, so that filling the holder 30 as described above can take place readily.

Figure 6:
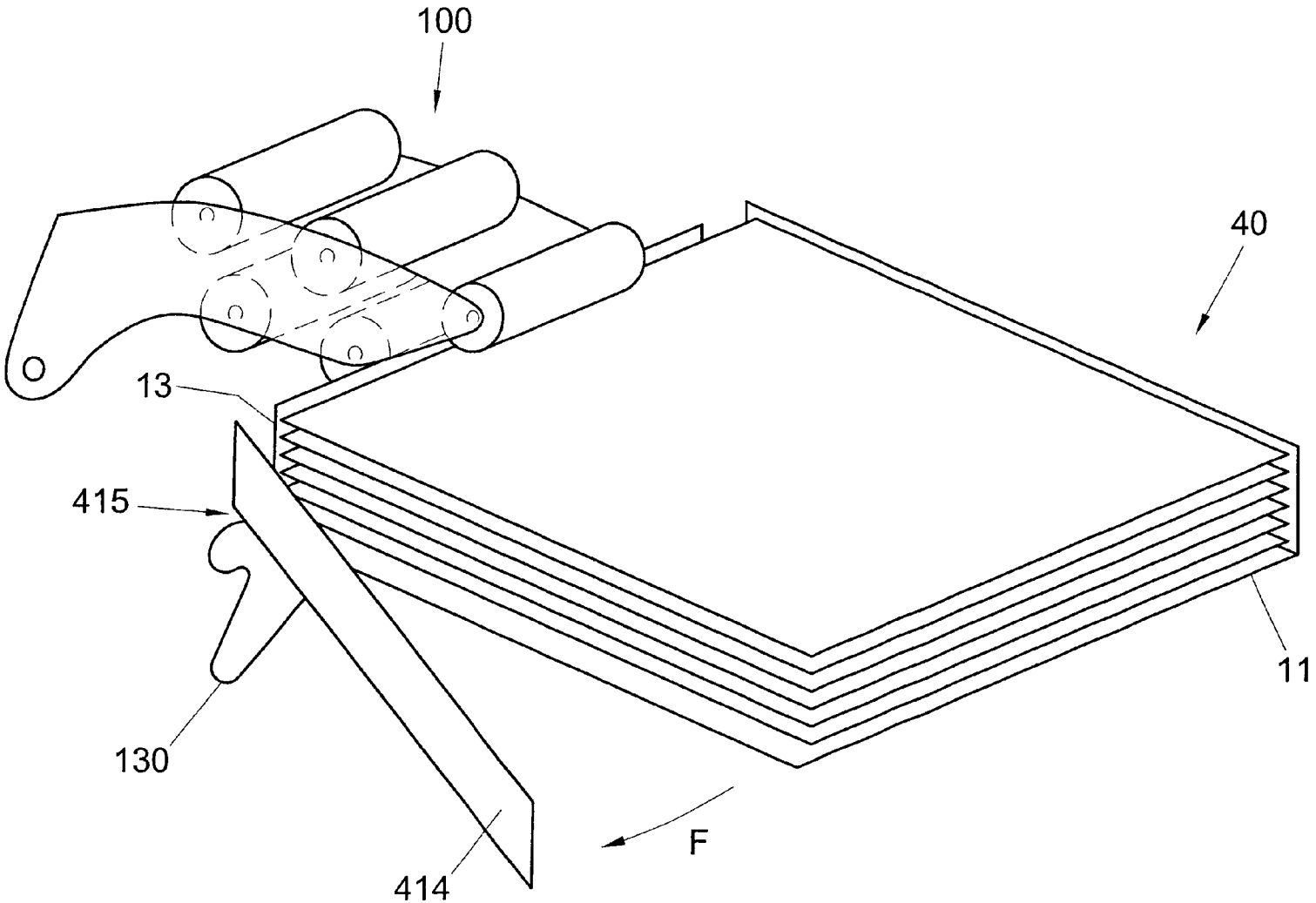
FIG. 6 is a perspective view of a fourth example of an apparatus according to the invention.

FIG. 6 shows a still further alternative embodiment of the invention. The holder 40 is again largely identical to the holder 10 according to the first exemplary embodiment, but is different as regards the construction of the movable side guide 414. The side guide 414 is connected at one end to the back wall 13 by means of a hinge 415 directed transversely to the platform 11. The working position of the side guide 414 corresponds to the working position as described in the first exemplary embodiment. However, the side guide 414 is moved to the filling position by swiveling the side guide 414 about the hinge 415 away from the platform 11, as is indicated by an arrow F in FIG. 6. In the filling position, the side guide 414 is swung clear from the platform 11, and hance located outside the working area of the holder 40, so that filling of the holder 40, as described before, can take place readily. As the side guide 414 hinges on the hinge 415 like a door, it is easy to operate. In this embodiment too, the effect arises that, as the side guide 14 is brought into the working position, the stack is additionally aligned if necessary.

Figure 7:
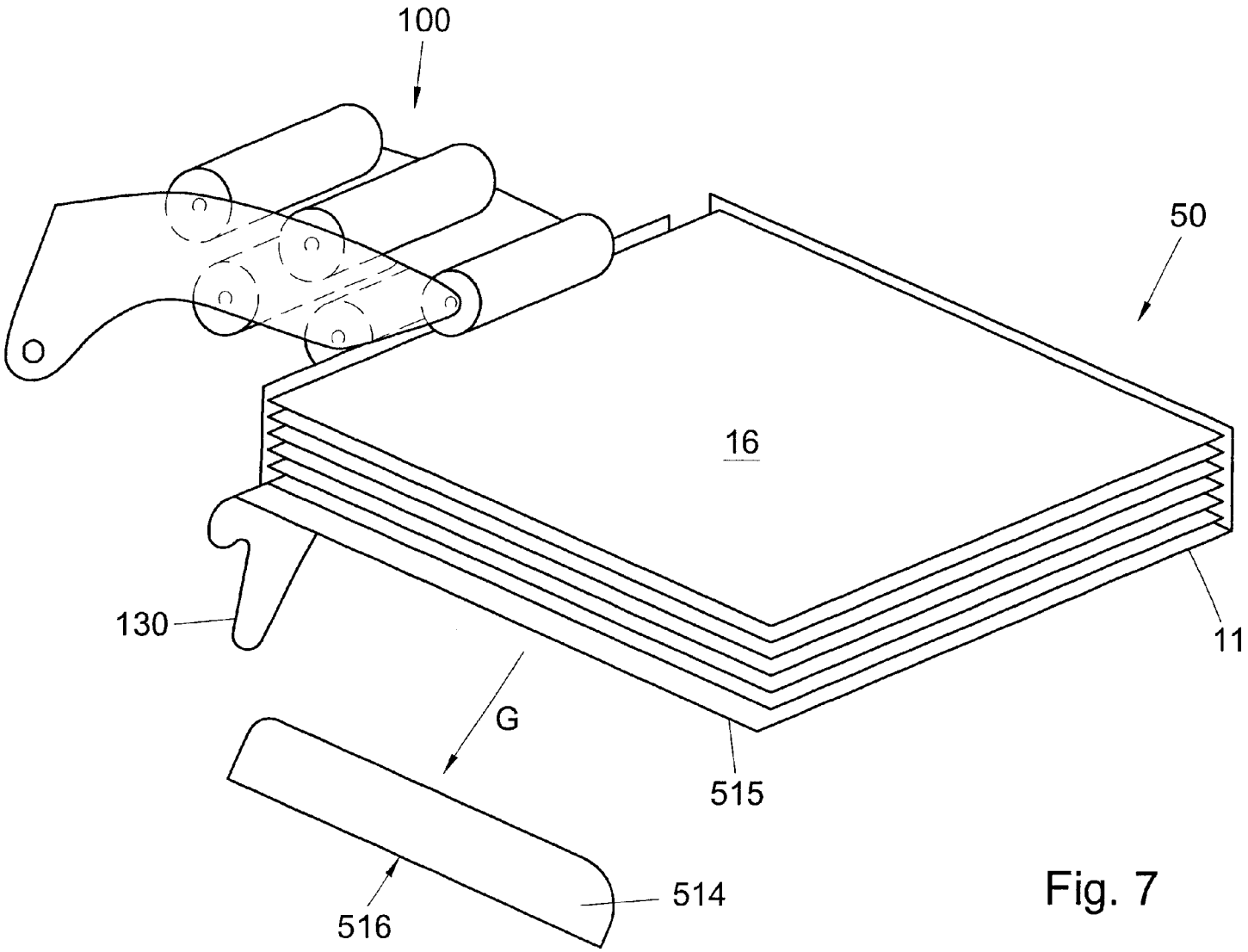
FIG. 7 is a perspective view of a fifth example of an apparatus according to the invention.

FIG. 7 shows a still further alternative embodiment of the invention. The holder 50 is largely identical to the holder 10 according to the first exemplary embodiment, but is different as regards the construction of the side guide 514. The platform 11 is provided, adjacent the edge, with a coupling 515. The side de 514 is provided, at a lower edge portion thereof, with a coupling 516 which is arranged to be coupled with the coupling 515 of the platform 11. In the working position, the side guide 514 is connected to the platform 11 by means of the couplings 515 and 516. To accomplish the filing position, the coupling between the couplings 515 and 516 is detached and the side guide 514 is removed from the platform 11, as symbolized by the arrow G. The side guide 614 has thus been brought outside the working area of the holder 50, so that filling the holder 50 as described hereinbefore can take place readily. Here, too, the stack 16 can be additionally aligned, if necessary, by pressing-on with the side guide 514.

Figure 8:
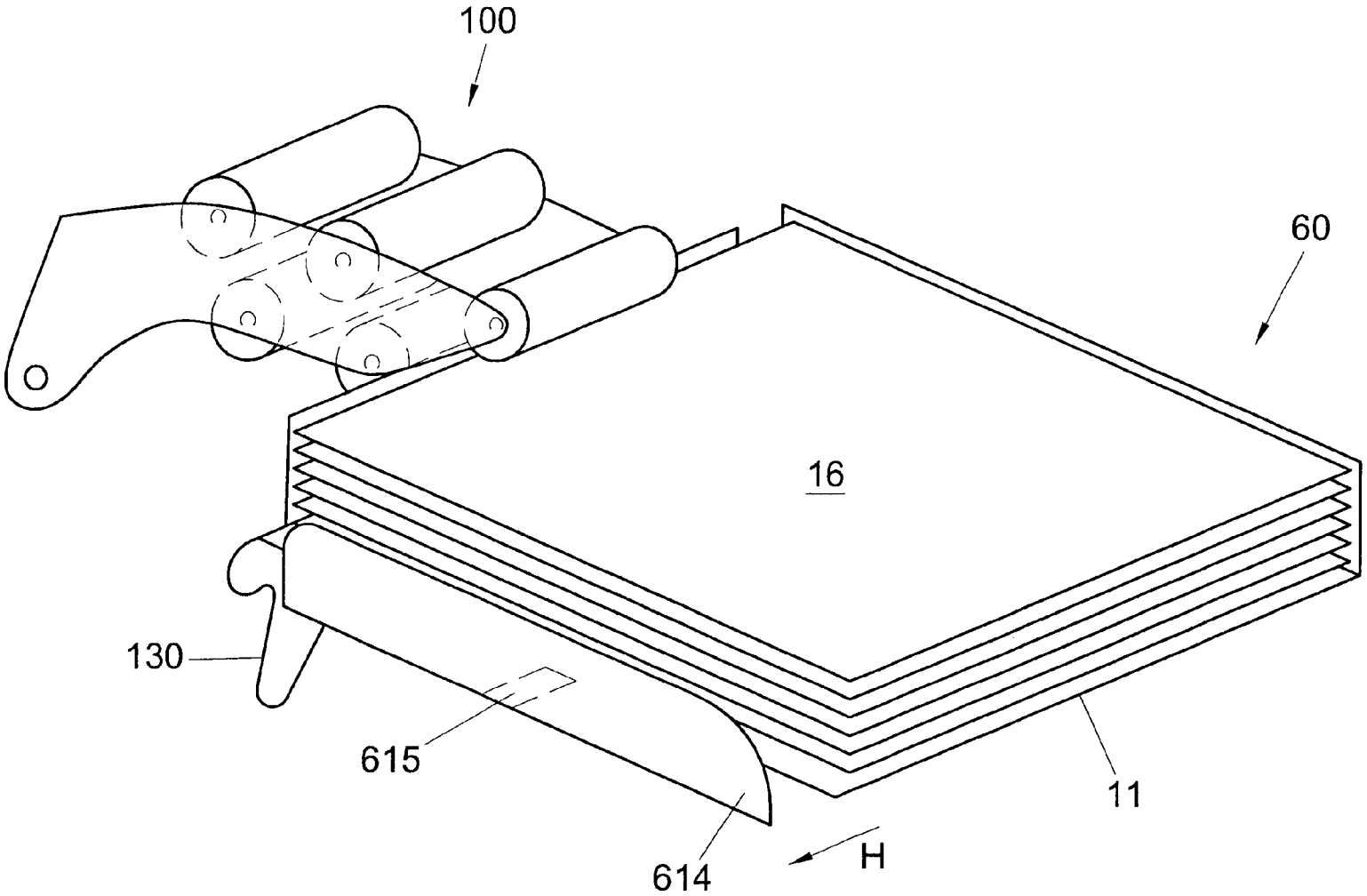
FIG. 8 is a perspective view of a sixth example of an apparatus according to the invention.

FIG. 8 shows a yet further alternative embodiment of the invention. The holder 60 is largely identical to the holder 10 according to the first exemplary embodiment, but differs as regards the construction of the side guide 614. The side guide 614 is connected to the platform 11 by means of an adjustable slide 615. By means of a slide 615, the side guide 614 can be moved between the working position, wherein the side guide 614 rests against the stack, and a filling position which is located remote from the stack. In the filling position, the side guide 614 is located remote from the working area, in that it has been moved in the direction indicated by an arrow H. The side guide 614 is then located outside the prolongation of the sheet path which passes between the rollers 107–109 and is thus located outside the working area of the holder 60, so that filling of the holder 60 is facilitated. When bringing the side guide 614 into the working position, the stack 16 can, if necessary, be additionally aligned through the press-on action of the side guide 614.

Figure 9:
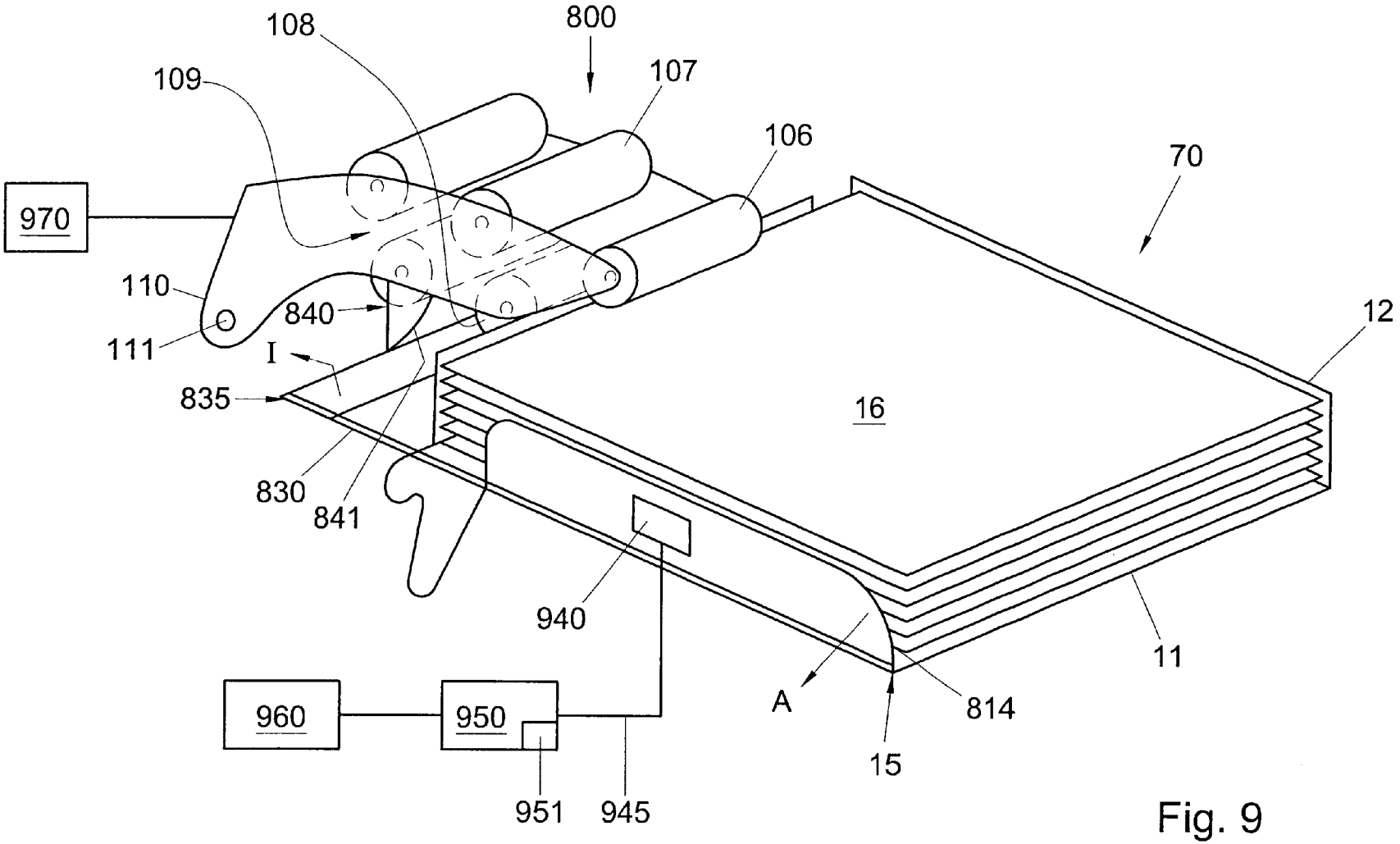
FIG. 9 is a perspective view of a seventh example of an apparatus according to the invention.

In FIG. 9 a yet further exemplary embodiment of the invention is shown. An apparatus 70 according to this example comprises a platform 11, a sidewall 12 and a side guide 814, pivotally mounted by means of a hinge 15, which side guide 814 corresponds to the side guide 14 from the first exemplary embodiment.

The separation device 800 corresponds to the separation device 100 from the foregoing examples.

The movable side guide 814 is provided with an axis 830 which extends in the prolongation of the hinge 815. Adjacent the end of the axis 830 remote from the side guide 814, a lever 835 is provided. This lever 835 in this example is designed as a substantially rectangular plate which is non-rotatably mounted with respect to the axis 830 and the side guide 814, the plane of the lever 835 and the plane of the side guide 814 mutually including an angle of substantially 90°. Accordingly, the lever 835 is vertically upright if the side guide 814 has been brought into the filling position, and located approximately in the horizontal plane of the platform 11 if the side guide 814 has been brought into the work position.

The frame of the separation device 800 is provided with a cam 840 which is formed by a plate placed in a plane parallel to the longitudinal direction of the rollers 106–109, with a slanted side 841 which extends from an area adjacent a first side of the frame 110 to a point adjacent a second side of the frame 110 in the direction of the rollers 106–109.

In a condition of use, the feed roller 106 of the separation device 800 rests on the stack 16, and sheets can be taken off the stack 16. The side guide 814 is located in the working position, and the lever 835 is therefore located in the plane of the platform 11. By now bringing the side guide 814 into the filling position by pivoting it in the direction A, the lever 835 is swung upwards from its horizontal position (arrow I). The end 836 of the lever 835 thereby engages the edge 841. Upon further swiveling of the lever 835, the end 836 of the lever 835 will slide further along the edge 841. The frame 110 is thereby lifted by the lever 835 and thereby pivoted upwards about the hinge 111. As a result, the feeding roller 106 comes clear of the uppermost sheet of the stack 16, or of the bottom of the holder 10. The side guide 814 is pivoted further into the filling position, with the lever 835 sliding further along the edge into the vertical position, whereby the frame 110 has reached its extreme upwardly swung position. The stack to be brought into the holder can now be readily brought under the feed roller 106.

By means of this coupling, formed by lever 835 and edge 841, bringing the side guide 814 into the filling position at the same time has as a consequence that the feeding of sheets is discontinued. This has as an advantage that no additional operations need to be performed by an operator to prevent sheets being taken off during filling. In addition, the separation device 800 is brought directly into a position which is most ideal for filling, while the opening for introducing a stack of paper into the holder 70 is large.

Although in this example the coupling between the side guide 814 and the device for switching off the separation device 800 is formed by a lever and a sliding edge, the invention is not limited to this embodiment. The invention is also applicable with other couplings between the side guide and the mechanism for releasing the feeding device and moving it away from the stack, such as, for instance, a pneumatic or hydraulic coupling or a logic coupling incorporated into operating software.

Alternatively, the holder 70 can be provided with a sensor 940. This sensor 940 is so constructed and arranged with respect to the holder 70 that the sensor 940 can detect the position or movement of the movable side guide 814. The sensor 940 can, for instance, be designed as a mechanical switch, an optical cell, or an inductive switch. The sensor 940 is arranged to produce a signal in response to the position of the side guide 814 and to deliver this signal via an output 945. The output 945 is connected with a signaling circuit 950, which is arranged for further processing the output signal of the sensor 940. The signaling circuit 950 can contain a signal generator 951 for generating human-perceptible signals, such as acoustic or optical signals. An acoustic signal generator such as a buzzer or a bell is then preferred because signals therefrom can also be perceived when no attention is being paid to the signal generator. Preferably, the signaling circuit is then so designed that in response to the holder 70 reaching an empty or at any rate near-empty status, the acoustic signal is generated and that this signal subsequently ends in response to the signal that the side guide has been brought into the filling position.

For that matter, according to the invention, the sensor 940 can also be provided on the sheet conveyor 1 on which the holder 70 is fitted by means of coupling elements 130.

Similarly to FIG. 2, the holder 70 is fitted on a sheet conveyor 1. The signaling circuit 950 is connected with or forms part of a control system 960 of the paper processing apparatus 1.

A signal indicating that the side guide 814 is in the filling position can be used to stop sheets being taken from the holder 70. The holders can then be refilled while the apparatus runs without refilling conflicting with attempts of the apparatus to take off a sheet from a holder which is being refilled. To that end, the separation device 100 comprises a control unit 970 which can move the separation device 100 between a take-off position and a rest position.

It is also possible, in response to a holder 70 getting empty, as well as in response to a side guide being in the filling position, to activate an alternative separation device and to store information indicating that the side guide of the holder 70 which has been empty has been in the filling position, and to use this information as an indication that after the alternative device has become empty, a switch can be made again to feeding sheets from the previously empty, now refilled holder 70. This provides the advantage that the apparatus makes a switch from feeding sheets from a different holder only if there is an indication that is has been refilled.

Further, a signal indicating that the holder 70 is being brought from the filling position to the working position can be used as a prompt to test whether paper is present in the holder 70.

By using the formation obtained with the sensor 940 for the movable side guide 914 for different control purposes, the operation of the apparatus can be supported while the amount of costly sensors can be limited.

Although in the examples in each case a holder has been shown which is in principle suitable for receiving a single-size sheetlike material, the invention is not in any way limited thereto. According to the invention, the holder can be of adjustable design, 50 that it can receive different sizes of sheets. To that end, for instance, one of the side guides can be designed to be adjustable in the plane of the platform. It is then preferred that the side guide which is fixed in the examples be made of adjustable design, since constructionally this requires the least effort. Also, the back wall can be designed to be adjustable in the plane of the platform.

I claim:

1. An apparatus for feeding sheetlike material from a stack, comprising a holder for receiving a stack of sheetlike material with a platform for supporting the stack and opposed side guides for guiding sheetlike material of the stack in a feeding direction, at least one of said side guides being displaceable relative to the other one, and a structure for feeding sheetlike material of the stack, wherein at least one of said side guides is movable between a working position projecting with respect to the platform for guiding sheets in a working area and a filling position in which said working area is at least partly cleared for passing therethrough sheets to be placed in the holder, wherein said at least one of said side guides is reciprocally pivotable between said filling position and said working position about a pivoting axis substantially directed in the feeding direction.

2. An apparatus for feeding sheetlike material from a stack, comprising a holder for receiving a stack of sheetlike material with a platform for supporting the stack and opposed side guides for guiding sheetlike material of the stack in a feeding direction, at least one of said side guides being displaceable relative to the other one, and a structure for feeding sheetlike material of the stack, wherein at least one of said side guides is movable between a working position projecting with respect to the platform for guiding sheets in a working area and a filling position in which said working area is at least partly cleared for passing therethrough sheets to be placed in the holder, wherein said at least one of said side guides is reciprocally pivotable between said filling position and said working position about a pivoting axis substantially directed in the feeding direction, and wherein said pivoting axis is located close to or under a plane defined by said platform.

3. An apparatus for feeding sheetlike material from a stack, comprising a holder for receiving a stack of sheetlike material with a platform for supporting the stack and opposed side guides for guiding sheetlike material of the stack in a feeding direction, at least one of said side guides being displaceable relative to the other one, and a structure for feeding sheetlike material of the stack, wherein at least one of said side guides is movable between a working position projecting with respect to the platform for guiding sheets in a working area and a filling position in which said working area is at least partly cleared for passing therethrough sheets to be placed in the holder, wherein said at least one of said side guides is reciprocally pivotable between said filling position and said working position about a pivoting axis directed substantially transversely to said platform in a downstream area of said holder.

4. An apparatus for feeding sheetlike material from a stack, comprising a holder for receiving a stack of sheetlike material with a platform for supporting the stack and opposed side guides for guiding sheetlike material of the stack in a feeding direction, at least one of said side guides being displaceable relative to the other one, and a structure for feeding sheetlike material of the stack, wherein at least one of said side guides is movable between a working position projecting with respect to the platform for guiding sheets in a working area and a filling position in which said working area is at least partly cleared for passing therethrough sheets to be placed in the holder, further comprising a feeding conveyor remote from the platform for engagement, in a working area, of an uppermost sheet of the stack and wherein said at least one of said side guides is coupled to said feeding conveyor for displacing said feeding conveyor away from said platform outside of said working area, in response to bringing said at least one of said side guides to said filling position.

5. An apparatus for feeding sheetlike material from a stack, comprising a holder for receiving a stack of sheetlike material with a platform for supporting the stack and opposed side guides for guiding sheetlike material of the stack in a feeding direction, at least one of said side guides being displaceable relative to the other one, and a structure for feeding sheetlike material of the stack, wherein at least one of said side guides is movable between a working position projecting with respect to the platform for guiding sheets in a working area and a filling position in which said working area is at least partly cleared for passing therethrough sheets to be placed in the holder, further comprising a sensor and a signaling circuit coupled to said side guide for operating said signaling circuit in response to bringing said at least one of said side guides to said filling position.

6. An apparatus according to claim 5, wherein the signaling circuit is provided with a signaling device for generating human-perceptible signals.

7. An apparatus according to claim 5, wherein the signaling circuit is arranged for generating a signal in response to said at least one of said side guides being in said filling position.

8. An apparatus according to claim 7, further comprising a second holder for receiving a stack of sheetlike material with a platform for supporting a second stack and opposed side guides for guiding sheetlike material of the second stack in a feeding direction, at least one of said side guides being displaceable relative to the other one, and a second structure for feeding sheetlike material from the second stack, further comprising means for activating the second one of said structures for feeding sheetlike material in response to the first one of said structures for feeding sheetlike material becoming empty or at least nearly empty, and means for preventing reactivation of the first one of said structures for feeding sheetlike material until after the termination of a signal that indicates that said displaceable side guide is in the filling position.

9. An apparatus according to claim 7, further comprising a second holder for receiving a stack of sheetlike material with a platform for supporting a second stack and opposed side guides for guiding sheetlike material of the second stack in a feeding direction, at least one of said side guides being displaceable relative to the other one, and a second structure for feeding sheetlike material of the second stack, further comprising means for activating the second one of said structures for feeding sheetlike material in response to a signal indicating that said displaceable side guide of the first-mentioned of said holders in the filling position.

* * * * *